US007284972B2

(12) United States Patent
Sun

(10) Patent No.: US 7,284,972 B2
(45) Date of Patent: Oct. 23, 2007

(54) SCROLL COMPRESSOR WITH STOP STRUCTURE TO PREVENT SLIDER BLOCK MOVEMENT

(75) Inventor: Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 11/386,279

(22) Filed: Mar. 22, 2006

(65) Prior Publication Data

US 2007/0224070 A1 Sep. 27, 2007

(51) Int. Cl.
*F03C 2/00* (2006.01)
*F04C 18/00* (2006.01)

(52) U.S. Cl. ..... 418/55.5; 418/57; 418/55.1

(58) Field of Classification Search ..... 418/55.1–55.6, 418/57
See application file for complete search history.

(56) References Cited

U.S. PATENT DOCUMENTS 5,308,231 A * 5/1994 Bookbinder et al. ..... 418/55.5
5,452,995 A * 9/1995 Izumi et al. ..... 418/55.5
5,496,158 A * 3/1996 Barito et al. ..... 418/55.5
5,575,635 A * 11/1996 Yamamoto et al. ..... 418/55.5
5,597,297 A * 1/1997 Yamamoto et al. ..... 418/55.1
6,352,417 B1 * 3/2002 Zamudio et al. ..... 418/55.5
2007/0009371 A1 * 1/2007 Patel et al. ..... 418/55.1

FOREIGN PATENT DOCUMENTS

JP 04072484 A * 3/1992 ..... 418/55.1
JP 04094483 A * 3/1992

* cited by examiner

*Primary Examiner*—Theresa Trieu
(74) *Attorney, Agent, or Firm*—Carlson, Gaskey & Olds

(57) ABSTRACT

A scroll compressor has a stop on its eccentric pin to selectively engage a notch in a slider block, and prevent the slider block from moving upwardly and contacting a rear surface of the orbiting scroll. The present invention prevents this unwanted contact, and the resultant wear.

10 Claims, 2 Drawing Sheets

SCROLL COMPRESSOR WITH STOP STRUCTURE TO PREVENT SLIDER BLOCK MOVEMENT

BACKGROUND OF THE INVENTION

This application relates to a scroll compressor having a slider block which is driven by an eccentric pin from a drive shaft, and wherein there is a stop structure on the eccentric pin to prevent the slider block from moving upwardly beyond the eccentric pin and contacting a rear surface of the orbiting scroll.

Scroll compressors have become widely utilized in refrigerant compression applications. In a scroll compressor, a first scroll member has a base and a generally spiral wrap extending from its base. The second scroll member has a base and a generally spiral wrap extending from its base. The generally spiral wraps interfit to define compression chambers. One of the two scroll members is caused to orbit relative to the other, and as it orbits the size of the compression chambers decreases and an entrapped fluid is compressed.

In one type of scroll compressor, the drive mechanism for causing the scroll member to orbit includes a drive shaft driven to rotate, and having an eccentric pin extending upwardly into a slider block. The slider block is received within a rearwardly extending boss in the orbiting scroll. The eccentric pin drives the orbiting scroll through the slider block. One concern with this type of scroll compressor is that the slider block has sometimes migrated upwardly and into contact with a rear face of the base of the orbiting scroll. This has resulted in undesirable wear.

It has been proposed to modify the slider block in a manner such as to have a bump or other structure on its uppermost surface to minimize the contact surface area with the orbiting scroll base, but still there is wear with the prior art.

SUMMARY OF THE INVENTION

In the disclosed embodiment of this invention, a stop structure is provided on the eccentric pin. This stop structure prevents the slider block from moving upwardly and contacting the orbiting scroll. In one embodiment, this stop structure is a slightly enlarged upper portion of the eccentric pin which fits into a notch in the slider block. While the two may be out of contact in most cases, should the slider block begin to migrate vertically upwardly, it will contact the stop, and the stop will prevent further movement. In one embodiment, the outside dimension of the eccentric pin at the stop is less than an inside dimension of a bore through the entirety of the slider block. This will facilitate assembly of the slider block onto the slider pin.

These and other features of the present invention can be best understood from the following specification and drawings, the following which is a brief description.

DETAILED DESCRIPTION OF THE PREFERRED EMBODIMENT

Figure 1A:
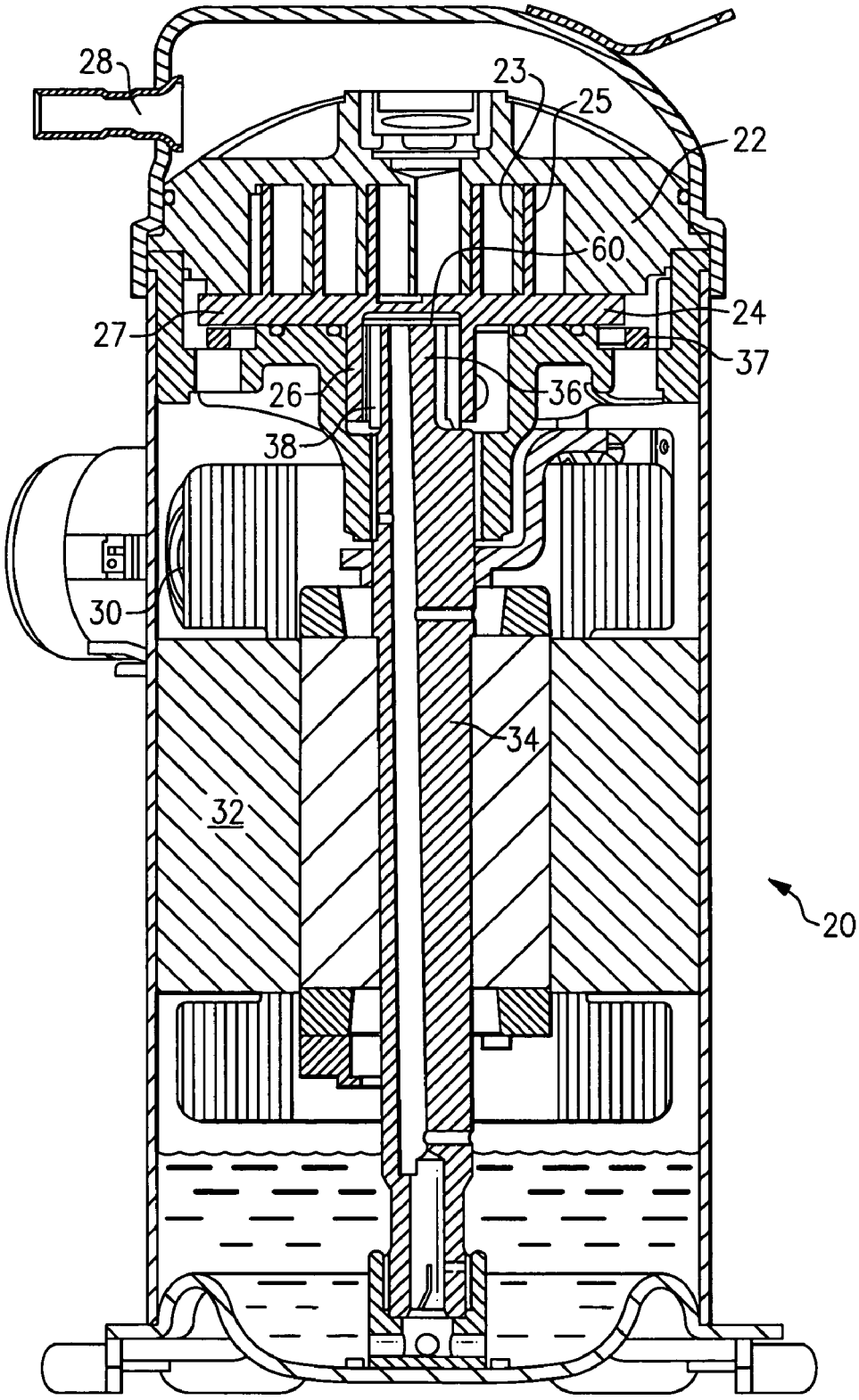
FIG.1A Prior Art
FIG. 1A shows a prior art scroll compressor.

A scroll compressor 20 is illustrated in FIG. 1A, and is as known in the art. A non-orbiting scroll 22 has a spiral wrap 23 extending from a base. An orbiting scroll 24 has a spiral wrap 25 extending from its base 27. The orbiting scroll 24 further has a boss 26 extending away from its base 27 in an opposed direction to the wrap 25.

Refrigerant is compressed in the compression chambers defined between the wraps 23 and 25 and delivered to a discharge port 28. Refrigerant enters the compressor housing through a section port 30.

The motor 32 drives a shaft 34 to rotate. The shaft 34 includes an eccentric pin 36 which is received within a slider block 38. The slider block sits within the boss 26, and between the boss and the eccentric pin 36. When the shaft 34 is caused to rotate, the eccentric pin moves the slider block, and hence the orbiting scroll 24 to orbit. An anti-rotation coupling 37 ensures that the orbiting scroll will not rotate, but instead orbits.

Figure 1B:
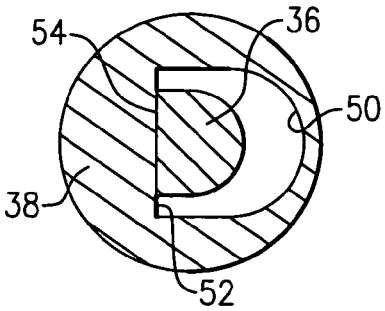
FIG.1B Prior Art
FIG. 1B shows another feature of the prior art scroll compressor.
Figure 2B:
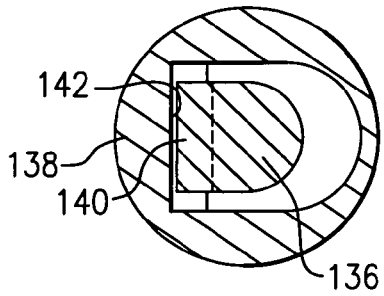
FIG. 2B shows a top view of one portion of this invention.
Figure 1C:
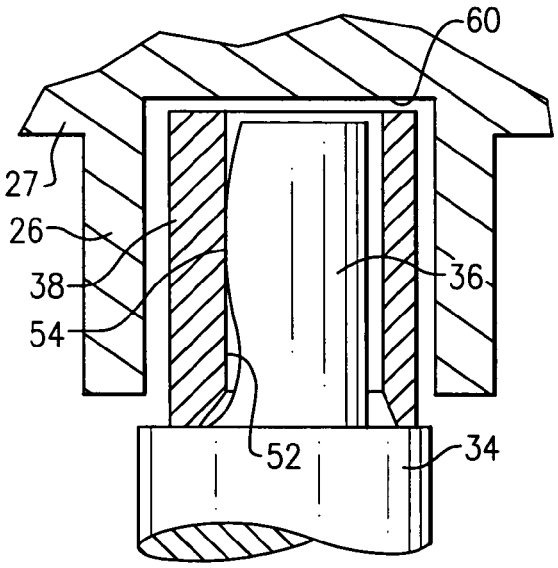
FIG.1C Prior Art
FIG. 1C shows yet another feature of the prior art scroll compressor.

One problem with this prior art scroll compressor can be appreciated from FIGS. 1B and 1C. The slider block 38 typically has an opening for receiving the eccentric pin 36 that is much larger than the pin 36. A flat surface 54 on the eccentric pin 36 engages a flat surface 52 in the bore in the slider block 38. When the motor is driven in a forward direction of rotation, forces within the scroll compressor cause the flat surface 54 to come into contact with the flat surface 52. When these forces are removed, the two can move out of contact with each other.

FIG. 1C is a view generally perpendicular to the FIG. 1B view. As shown, the "flat" surface 54 is not truly flat, but actually has a slight barrel shape. With this prior art, there is sometimes a problem in that the slider block 38 has migrated vertically upwardly, and contacted the rear surface 60 of the base 27. This is undesirable.

Figure 2A:
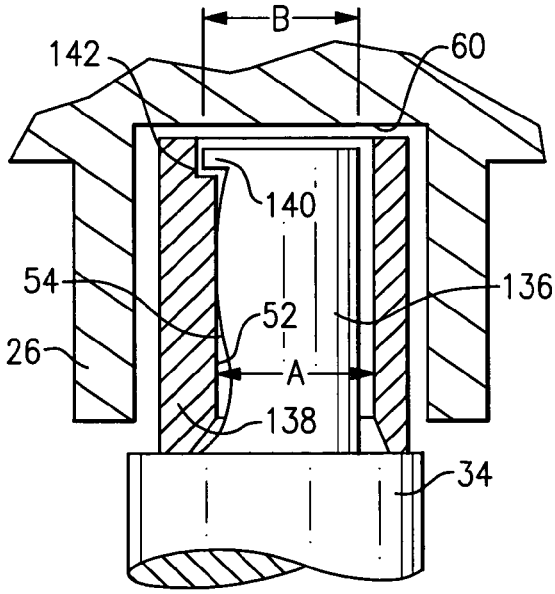
FIG. 2A shows the inventive scroll compressor.

As is clear, the slider block 138 is positioned vertically beneath the stop 140. Thus, the slider block 138 will normally be held by gravity at the position illustrated in FIG. 2A at which the stop 140 is out of contact with the notch 142, and as is clearly illustrated in FIG. 2A.

In this manner, the present invention provides a simple and effective method of preventing a slider block from contacting the rear of a base of an orbiting scroll. While a preferred embodiment of this invention has been disclosed, a worker of ordinary skill in the art would recognize that certain modifications would come within the scope of this invention. For that reason, the following claims should be studies to determine the true scope and content of this invention.

I claim:

1. A scroll compressor comprising:

a first scroll member having a base and a generally spiral wrap extending from said base;

a second scroll member having a base and a generally spiral wrap extending from its base, said spiral wraps of said first and second scroll members interfitting to define compression chambers;

a driveshaft and a motor for rotating said driveshaft, said driveshaft having an eccentric pin extending from one end of said driveshaft;

said second scroll member being caused to orbit by said eccentric pin, and said second scroll member having a boss extending in an opposed direction from said base compared to said spiral wrap, said boss including an opening receiving a slider block and said eccentric pin with said slider block being intermediate said eccentric pin and said boss, and said boss having an upper surface defining a rear surface of said base of said second scroll member;

stop structure on said eccentric pin for selectively contacting a stop surface on said slider block and preventing movement of said slider block toward said rear surface, said stop structure on said eccentric pin being spaced toward said second scroll member relative to said stop surface on said slider block, and said stop structure being out of contact with said stop surface in most cases; and said slider block being positioned vertically beneath said stop structure on said eccentric pin such that said slider block will fall vertically out of contact with said stop surface.

2. The scroll compressor set forth in claim 1, wherein said eccentric pin has a drive flat surface which is selectively moved into engagement with a mating flat surface within a bore in said slider block.

3. The scroll compressor as set forth in claim 2, wherein said flat surface on said eccentric pin has a slight barrel shape.

4. The scroll compressor as set forth in claim 1, wherein an outermost dimension on said eccentric pin including said stop structure is less than an inner dimension of a bore in said slider block, to provide clearance as said slider block is moved over said eccentric pin during assembly.

5. The scroll compressor as set forth in claim 1, wherein said eccentric pin and said slider block have mating drive surfaces that are brought into contact when said second scroll member is caused to orbit in a forward direction, and a length of said stop surface on said slider block measured along said drive surface is greater than a length of said stop structure on said eccentric pin measured along said drive surface.

6. A scroll compressor comprising:

a first scroll member having a base and a generally spiral wrap extending from said base;

a second scroll member having a base and a generally spiral wrap extending from its base, said spiral wraps of said first and second scroll members interfitting to define compression chambers;

a driveshaft and a motor for rotating said driveshaft, said driveshaft having an eccentric pin extending from one end of said driveshaft;

said second scroll member being caused to orbit by said eccentric pin, and said second scroll member having a boss extending in an opposed direction from said base compared to said spiral wrap, said boss including an opening receiving a slider block and said eccentric pin with said slider block being intermediate said eccentric pin and said boss, and said boss having an upper surface defining a rear surface of said base of said second scroll member; and stop structure on said eccentric pin for selectively contacting a stop surface on said slider block and preventing movement of said slider block toward said rear surface; and said stop includes a single stop extending beyond the nominal surface of said eccentric pin, and said stop surface in said slider block includes a notch in an extreme surface of said slider block which selectively contacts said stop.

7. A scroll compressor comprising:

a first scroll member having a base and a generally spiral wrap extending from said base;

a second scroll member having a base and a generally spiral wrap extending from its base, said spiral wraps of said first and second scroll members intermitting to define compression chambers;

a driveshaft and a motor for rotating said driveshaft, said driveshaft having an eccentric pin extending from one end of said driveshaft;

said second scroll member being caused to orbit by said eccentric pin, and said second scroll member having a boss extending in an opposed direction from said base compared to said spiral wrap, said boss including an opening receiving a slider block and said eccentric pin with said slider block being intermediate said eccentric pin and said boss, and said boss having an upper surface defining a rear surface of said base of said second scroll member, said eccentric pin has a drive flat surface which is selectively moved into engagement with a mating flat surface within a bore in said slider block; and a stop on said eccentric pin for selectively contacting a notch on said slider block and preventing movement of said slider block toward said rear surface, said stop includes a single stop extending beyond a nominal surface of said eccentric pin.

8. The scroll compressor as set forth in claim 7, wherein said flat on said eccentric pin has a slight barrel shape.

9. The scroll compressor as set forth in claim 7, wherein an outermost dimension on said eccentric pin including said stop structure is less than an inner dimension of a bore in said slider block, such that said slider block can be moved over said eccentric pin.

10. The scroll compressor as set forth in claim 7, wherein said eccentric pin and said slider block have mating drive surfaces that are brought into contact when said second scroll member is caused to orbit in a forward direction, and a length of said stop structure on said slider block measured along said drive surface is greater than a length of said stop structure on said eccentric pin measured along said drive surface.

* * * * *

UNITED STATES PATENT AND TRADEMARK OFFICE

CERTIFICATE OF CORRECTION

PATENT NO. : 7,284,972 B2
APPLICATION NO. : 11/386279
DATED : October 23, 2007
INVENTOR(S) : Sun It is certified that error appears in the above-identified patent and that said Letters Patent is hereby corrected as shown below:

Claim 7, Column 4, line 15: "intermitting" should read as --interfitting--

Signed and Sealed this

Twenty-fifth Day of March, 2008

JON W. DUDAS
*Director of the United States Patent and Trademark Office*